United States Patent [19]

Homes

[11] Patent Number: 4,955,957

[45] Date of Patent: Sep. 11, 1990

[54] PORTABLE COOLER

[76] Inventor: Hunter Homes, P.O. Box 1, Garoon Valley, Id. 83622

[21] Appl. No.: 393,627

[22] Filed: Aug. 14, 1989

[51] Int. Cl.[5] ..... B65D 6/00; B65D 43/16

[52] U.S. Cl. ..... 220/324; 224/0.5; 224/273

[58] Field of Search ..... 62/259.3, 457.1, 457.9, 62/457.7; 220/324, 315, 318, 323, DIG. 10; 206/231, 427, 803; 224/30 A, 309, 315, 329, 330, 0.5, 273; 190/25, 26, 27; 24/265 CD

[56] References Cited

U.S. PATENT DOCUMENTS

| | | | |
|---|---|---|---|
| 2,315,692 | 4/1943 | Ditchfield | 220/324 X |
| 2,434,387 | 1/1948 | Brandt | 224/329 X |
| 2,735,377 | 2/1956 | Elsher | 24/265 CD |
| 2,947,436 | 8/1960 | Kappen | 220/324 X |
| 4,261,448 | 4/1981 | Myers et al. | 190/27 X |
| 4,739,900 | 4/1988 | Borst | 220/315 X |

FOREIGN PATENT DOCUMENTS

| | | | |
|---|---|---|---|
| 552350 | 1/1958 | Canada | 24/265 CD |
| 10944 | 3/1907 | Denmark | 220/324 |

*Primary Examiner*—Stephen Marcus

*Attorney, Agent, or Firm*—Sprung, Horn, Kramer & Woods

[57] ABSTRACT

A portable and which includes means for securing it to a carrier surface, the cooler contents being fully protected thermally but being available readily without undoing the securing means.

4 Claims, 2 Drawing Sheets

PORTABLE COOLER

BACKGROUND OF THE INVENTION

This invention relates to a portable cooler which may be securely lashed to a raft or the like while allowing simple means for gaining access to its contents.

Coolers are known comprising parallelopiped structures with large tops which may be separated from a bottom of generally similar shape to gain access to the contents of the cooler, e.g., U.S. Pat. No. 4,351,165.

In U.S. Pat. No. 4,667,484, there is provided a cooler with a top much shorter in height than the bottom which it closes off but in width and breadth of the same dimensions as the bottom.

The cooler of U.S. Pat. No. 4,721,237 also has a full-size top plus an auxiliary pocket for gaining access to the interior, although apparently the thermal insulation is diminished in the vicinity of such pocket.

These devices function well but if lashed or strapped to a raft, a boat, a person, a pack animal or a vehicle, it is first necessary to unstrap the devices and then to take measures to gain access to the contents.

It is accordingly an object of the present invention to provide a cooler which is portable and which includes means for securing it to a carrier surface, the cooler contents being fully protected thermally but being available readily without undoing the securing means.

DESCRIPTION OF THE INVENTION

This and other objects are realized in accordance to the present invention pursuant to which there is provided a portable cooler comprising a wall portion, a base and a top, said top having a surface defining an opening into the interior of the cooler to allow the placing of items into and withdrawing of items from the cooler, said surface defining an area extending past said opening dimensioned to allow lashing means to extend thereacross without interfering with said opening so as to allow the securing of the cooler to a surface, and a lid for closing and extending said opening.

Advantageously, the opening is centered in the top, extends substantially the entire width of the top and the lashing means provide for securing the cooler across the width of the top and are located on either side of the opening. The lashing means preferably comprises a pair of spaced grooves in the top, one groove being on each side of the opening. Cross-wise retaining studs may be provided in the grooves to secure carrying straps in the grooves. The lid may be hinged to the body or may be designed so that it lifts off completely or can be locked to the wall portion. Preferably the portable cooler is substantially a rectangular parallelopiped in configuration. The cooler may optionally be contoured like a back-pack. The cooler may be made of wood, aluminum, etc., but is preferably made of two spaced plastic sheets joined at their edges with the space filled with expanded polystyrene.

Figure 1:
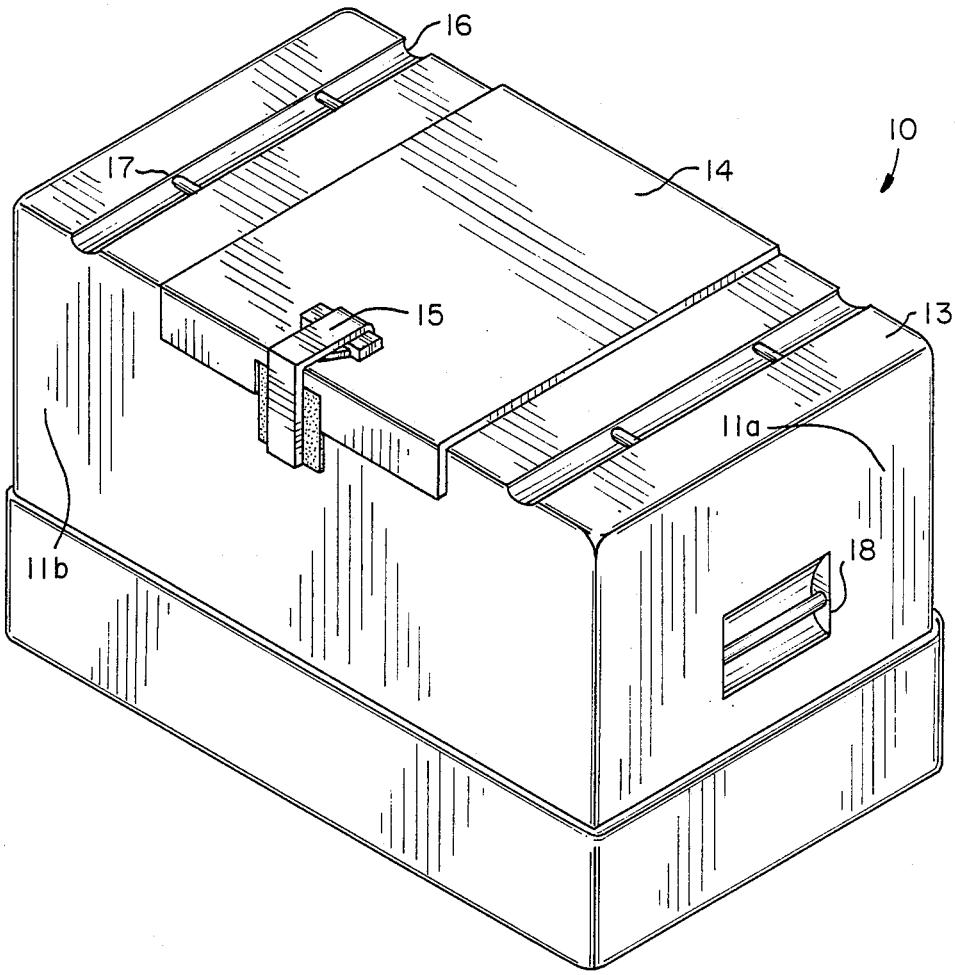
Figure 2:
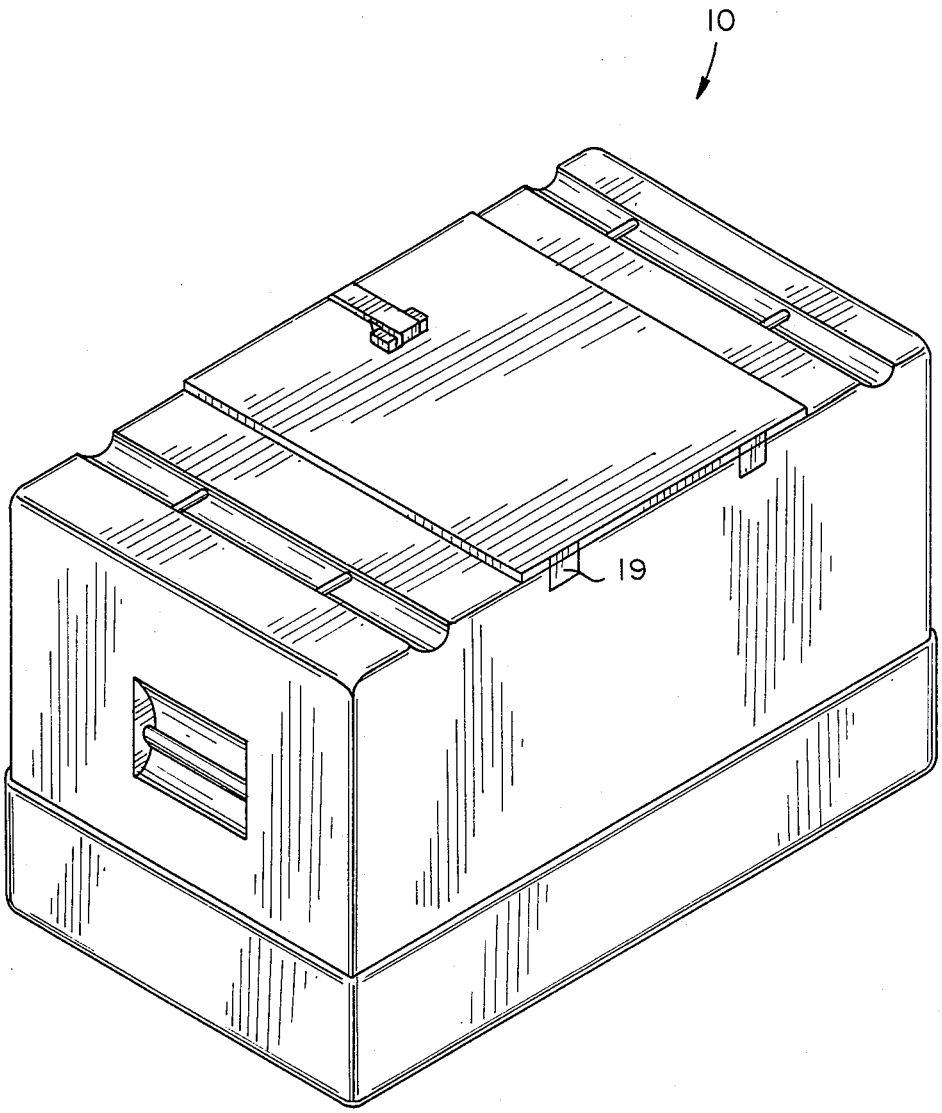

The invention will be further described with reference to the accompanying drawings wherein:

FIG. 1 is a perspective view of the portable cooler in accordance with the invention; and FIG. 2 is another perspective view of the portable cooler in accordance with the invention.

Referring more particularly to FIG. 1, there is shown a cooler comprising an outer shell 10 made up of four adjoining walls 11*a*, 11*b*, etc., an integral base 12 and a top 13. The cooler is fitted with a lid 14, which covers the opening and which may be locked to wall portion 11*b* by means of locking means 15, which comprises hook and loop system strips. The top 13 is fitted with two grooves 16, one positioned on either side of the lid 14, each groove 16 being fitted with cross-wise retaining studs 17 to secure carrying straps in the grooves. The cooler is further fitted with handles 18.

Referring now more particularly to FIG. 2, there are provided hinges 19 to secure the lid to the body of the cooler and to allow the lid to swing to expose or close the opening.

It will be appreciated that the instant specification and claims are set forth by way of illustration and not limitation, and that various modifications and changes may be made without departing from the spirit and scope of the present invention.

We claim:

1. A portable cooler comprising a wall portion, a base and a top, said top having a surface defining an opening into the interior of the cooler to allow the placing of items into and withdrawing of items from the cooler, said opening being centered in and extending substantially the entire width of the top, said surface defining an area extending past said opening, a pair of spaced grooves in the top, one groove being on each side of the opening, lashing means extending across the top in said grooves without interfering with said opening so as to allow the securing of the cooler to a surface, and a lid for closing and exposing said opening.

2. A portable cooler according to claim 1, including at least one stud in each groove extending transverse of the groove and spaced from the bottom of the groove, whereby a strap can be positioned in each groove passing below the stud.

3. A portable cooler according to claim 1, which is substantially a rectangular parallelopiped in configuration.

4. A portable cooler according to claim 1, including means for locking the lid to the wall portion.

* * * * *

UNITED STATES PATENT AND TRADEMARK OFFICE

CERTIFICATE OF CORRECTION

PATENT NO. : 4,955,957

DATED : September 11, 1990

INVENTOR(S) : Hunter Homes

It is certified that error appears in the above-identified patent and that said Letters Patent is hereby corrected as shown below:

| | |
|---|---|
| Title Page | U. S. PATENT DOCUMENTS: After " 2,735, 377, 2/1956, " delete " Elsher " and substitute -- Elsner -- |

Signed and Sealed this

Twenty-eighth Day of April, 1992

*Attest:*

HARRY F. MANBECK, JR.

*Attesting Officer*

*Commissioner of Patents and Trademarks*